US008769736B2

(12) United States Patent
Ball

(10) Patent No.: US 8,769,736 B2
(45) Date of Patent: Jul. 8, 2014

(54) DEVICE FOR CONCEALING A PLATE ASSOCIATED WITH OVERFLOW PLUMBING

(75) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 924 days.

(21) Appl. No.: 12/896,137

(22) Filed: Oct. 1, 2010

(65) Prior Publication Data

US 2012/0079654 A1 Apr. 5, 2012

(51) Int. Cl.
*E03C 1/244* (2006.01)

(52) U.S. Cl.
CPC ..... *E03C 1/244* (2013.01)
USPC ..... 4/694

(58) Field of Classification Search
CPC ..... A47K 3/00; E03C 1/24
USPC ..... 4/679–694
See application file for complete search history.

(56) References Cited

U.S. PATENT DOCUMENTS 1,331,018 A * 2/1920 Luthy ..... 429/143
1,371,715 A * 3/1921 West ..... 248/244
1,712,704 A * 5/1929 Kiser ..... 248/240.1
1,923,482 A * 8/1933 Frankenstein ..... 248/240.1
2,096,651 A * 10/1937 Romeo ..... 4/443
2,150,483 A * 3/1939 Bentz ..... 4/574.1
2,193,527 A * 3/1940 Bentz ..... 4/579
2,664,142 A * 12/1953 Scheuerman et al. ..... 248/124.1
2,670,029 A * 2/1954 Rossi ..... 248/240.1
2,965,153 A * 12/1960 Purcell, Sr. ..... 248/240.1
3,082,432 A * 3/1963 Pearlman ..... 4/447
3,121,879 A * 2/1964 Young ..... 4/694
3,528,112 A * 9/1970 Warnick ..... 4/568
4,087,127 A * 5/1978 Lotta ..... 297/14
4,127,904 A * 12/1978 Junker ..... 4/420.4
4,475,256 A * 10/1984 Hatala ..... 4/562.1
4,520,515 A * 6/1985 Hatala ..... 4/579
4,574,409 A * 3/1986 McAffrey ..... 4/579
4,945,579 A * 8/1990 Husting ..... 4/688
5,123,123 A * 6/1992 Hart et al. ..... 4/684
5,745,931 A 5/1998 Ball
5,758,368 A 6/1998 Ball
5,890,241 A 4/1999 Ball
6,066,119 A 5/2000 Ball
6,105,183 A * 8/2000 Bly ..... 4/579
6,138,298 A * 10/2000 Ball ..... 4/694
6,148,454 A 11/2000 Ball
6,154,898 A 12/2000 Ball
6,158,809 A * 12/2000 Gobbers et al. ..... 297/344.17
6,173,459 B1 1/2001 Ball
6,216,288 B1 * 4/2001 Bernau ..... 4/694
6,226,806 B1 5/2001 Ball
6,272,699 B1 * 8/2001 Peterson ..... 4/680
6,295,664 B2 * 10/2001 Fritz et al. ..... 4/679
6,317,906 B1 11/2001 Ball
6,418,570 B1 7/2002 Ball
6,546,573 B1 4/2003 Ball
6,631,623 B1 10/2003 Ball (Continued)

*Primary Examiner* — Lori Baker
(74) *Attorney, Agent, or Firm* — Sheridan Ross P.C.

(57) ABSTRACT

An overflow plate concealing device for bathtubs that is associated with a plate of an overflow system of the bathtub. This aspect of the invention allows the overflow plate to be concealed to allow the user to alter the aesthetic appearance of their bathtub or repair the same.

10 Claims, 7 Drawing Sheets

(56) References Cited

U.S. PATENT DOCUMENTS

| | | | | |
|---|---|---|---|---|
| 6,637,050 | B1 * | 10/2003 | Ball | 4/680 |
| 6,640,358 | B2 | 11/2003 | Ball | |
| 6,675,406 | B2 | 1/2004 | Ball | |
| 6,675,407 | B1 | 1/2004 | Ball | |
| 6,681,420 | B1 * | 1/2004 | Ball | 4/680 |
| 6,687,926 | B1 * | 2/2004 | Bayley | 4/681 |
| 6,691,411 | B2 | 2/2004 | Ball | |
| 6,823,540 | B2 * | 11/2004 | Gunn | 4/680 |
| 6,836,911 | B2 * | 1/2005 | Minnick | 4/694 |
| 7,096,522 | B2 * | 8/2006 | Hirtriter | 4/694 |
| 7,127,752 | B2 | 10/2006 | Ball | |
| 7,328,953 | B2 * | 2/2008 | Werschmidt | 297/354.13 |
| 7,451,502 | B2 | 11/2008 | Ball | |
| 7,503,083 | B2 | 3/2009 | Ball | |
| 7,506,385 | B2 * | 3/2009 | Werschmidt | 4/561.1 |
| 7,549,702 | B2 * | 6/2009 | Meyers | 297/344.18 |
| 7,774,871 | B1 * | 8/2010 | Arsenault | 4/568 |
| 7,856,677 | B1 * | 12/2010 | Harris | 4/295 |
| 8,266,735 | B2 * | 9/2012 | McLeod | 4/494 |
| 2003/0192115 | A1 * | 10/2003 | Oropallo et al. | 4/694 |
| 2004/0068793 | A1 | 4/2004 | Ball | |
| 2004/0103474 | A1 | 6/2004 | Ball | |
| 2004/0111797 | A1 | 6/2004 | Ball | |
| 2004/0117907 | A1 | 6/2004 | Ball | |
| 2007/0039098 | A1 | 2/2007 | Ball | |
| 2007/0130689 | A1 | 6/2007 | Condon et al. | |
| 2008/0047060 | A1 | 2/2008 | Ball | |
| 2008/0196161 | A1 | 8/2008 | Ball | |
| 2008/0235866 | A1 | 10/2008 | Ball | |

* cited by examiner

DEVICE FOR CONCEALING A PLATE ASSOCIATED WITH OVERFLOW PLUMBING

CROSS REFERENCE TO RELATED APPLICATIONS

This application is related to various applications and patents related to overflow systems associated with bathtubs or other basins, such as U.S. patent application Ser. No. 09/593,724, filed Jun. 13, 2000, U.S. Patent Application Publication Nos. 2004/0,068,793, filed Sep. 30, 2003, 2004/0,117,907, filed Dec. 10, 2003, 2004/0,111,797, filed Dec. 17, 2003, 2008/0,235,866, filed Mar. 28, 2008 and 2004/0,103,474 filed Nov. 25, 2003. In addition, this application is related to U.S. Pat. Nos. 6,691,411, filed Sep. 17, 2001, 6,675,406, filed Aug. 28, 2002, 6,637,050, filed Aug. 16, 2002, 7,127,752, filed Dec. 17, 2003 and 5,890,241, filed Feb. 4, 1998. The entire disclosures of which are incorporated by reference herein.

FIELD OF THE INVENTION

Embodiments of the present invention generally relate to devices for concealing a portion of a bathtub's overflow plumbing. One embodiment of the present invention, specifically, employs a cover that conceals an existing overflow plate, which allows selective alterations or repairs to the overflow plumbing.

BACKGROUND OF THE INVENTION

Overflow plumbing is commonly associated with basins for holding fluids. Overflow systems provide an access point for drain clean out and may help address substantial overfilling of the basin. Bathtubs, for example, employ overflow assemblies comprised of an overflow pipe that is associated with an outlet port of the bathtub and that is interconnected to a sidewall of the bathtub. An overflow plate conceals the outlet port. The overflow plate includes at least one fluid flow opening that allows water to flow from the bathtub to the overflow pipe if the need arises.

Often, it is desirous to change the look and feel of a bathroom. One way to accomplish this is to change plumbing fixtures associated with the bathtub, sink, etc. For example, one may want to change an existing faucet and related plumbing components from a nickel-plated finish to a chrome plated finish, or vice versa. This task may seem simple, but it is often laborious, and, as one of skill in the art will appreciate, may require that all, or portions of, the plumbing system associated with the bathtub, sink, etc. be re-tested. For example, attention is directed to U.S. Pat. No. 5,890,241 to Ball ("Ball I"), which is incorporated by reference in its entirety herein. Ball I provides an overflow plumbing system having an overflow pipe that is associated with a bathtub having a cover plate interconnected to the overflow pipe by way of at least one fastener. The fasteners cooperate with bosses associated with the overflow pipe to hold the cover in place. The overflow system of Ball I is primarily aligned with the outer portion surface of the bathtub, and as a result, a sleeve is required which engages an inner surface of the bathtub and the overflow pipe, to hold the overflow pipe in place. One of skill in the art will appreciate that the aligning of the sleeve and the overflow pipe is difficult as the overflow pipe is located behind the bathtub wall and generally out of view and difficult to access. Furthermore, interconnection of the screw to the bosses of the overflow pipe is difficult, as adjustments cannot be made easily. Thus replacing overflow plates commonly found in many bathrooms is often very difficult, time consuming and expensive.

This difficulty of replacing existing cover plates has been addressed by leaving it in place and concealing the same with a supplemental cover. For example, attention is directed to U.S. Pat. No. 6,138,298 to Ball ("Ball II"), which is incorporated by reference in its entirety herein. Ball II discloses a cover having a clip integrated on an interior surface thereof. To install, the clip is at least partially slid into a fluid opening associated with the existing overflow plate. The clip holds the cover in place that conceals the existing plate while maintaining an opening that allows fluid to flow from the bathtub to the overflow pipe. One drawback with Ball II is that the clip may fail or loosen over time, thereby allowing the cover to slip relative to the overflow plate. Furthermore, the clip somewhat obstructs the fluid opening provided by the existing overflow plate, which may decrease fluid flow rate into the overflow pipe. Finally, the device of Ball II may not fit accommodate many overflow plates.

Thus, it is a long felt need to provide a device for concealing an overflow plate that is easy to install, does not interfere with the flow characteristics of the overflow system, and is universal in nature, i.e., concealing overflow plates of various shapes, sizes, and styles.

SUMMARY OF THE INVENTION

It is one aspect of the present invention to provide a device for concealing a cover plate of an overflow system. More specifically, overflow systems of some bathtubs are comprised of an overflow pipe having a plate for association with an outer surface of a bathtub. A sleeve is interconnected to the overflow pipe wherein an inner surface of the sleeve and the plate firmly engage the bathtub to hold the overflow pipe in place. That is, the bathtub wall is positioned between the inner surface of the sleeve and the plate, thereby securing the overflow pipe to the bathtub. In order to conceal the opening associated with the overflow pipe, an overflow plate is included that is interconnected to the sleeve and/or overflow pipe by way of at least one screw or other fastening mechanism. One of skill in the art will appreciate upon review of the following that embodiments of the present invention can be used in conjunction with many overflow systems. The overflow plate includes at least one opening that allows a fluid from inside the bathtub to enter into the sleeve and overflow pipe when the liquid level in the bathtub reaches a predetermined level.

One embodiment of the present invention is an overflow plate cover having an outer surface with a wall extending therefrom. The wall includes an aperture that aligns with the fluid opening of the overflow plate to maintain the fluid passage from inside the bathtub to the overflow pipe. The contemplated cover is associated with the overflow plate by way of a retention plate, which will be described in further detail below.

In operation, fasteners, which interconnect the overflow plate to the overflow pipe, are loosened to allow the overflow plate to be pulled from the bathtub wall. Next, the retention plate is positioned between the overflow plate and the bathtub wall. The fasteners are tightened to affix the retention plate between the overflow plate and the bathtub wall.

One embodiment of the present invention includes a retention plate with a lip that receives at least one protrusion associated with the wall of the overflow plate cover to hold the overflow plate cover in place. The overflow plate cover is able to rotate relative to the retention plate. To ensure the fluid passage is unobstructed, an aperture or cut out in the overflow plate cover wall is rotated and positioned generally in line with the fluid opening of the overflow plate.

In an alternative embodiment of the present invention, the overflow plate cover is glued or otherwise bonded to the bathtub wall. The overflow plate cover of this embodiment of the present invention would also include an outer surface and an inner surface with a wall depending therefrom. The inner surface is spaced from an outer surface of the overflow plate. In one embodiment, the wall also includes an outwardly or inwardly extending lip to receive the bonding material and is associated with the bathtub wall.

It is another aspect of the present invention to provide an overflow plate cover that will conceal overflow plates of various styles, sizes, and shapes. Those of skill in the art appreciate that overflow plates are not standard. One embodiment of the present invention is thus of such size and shape to accommodate most, if not all, of the overflow plates on the market.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
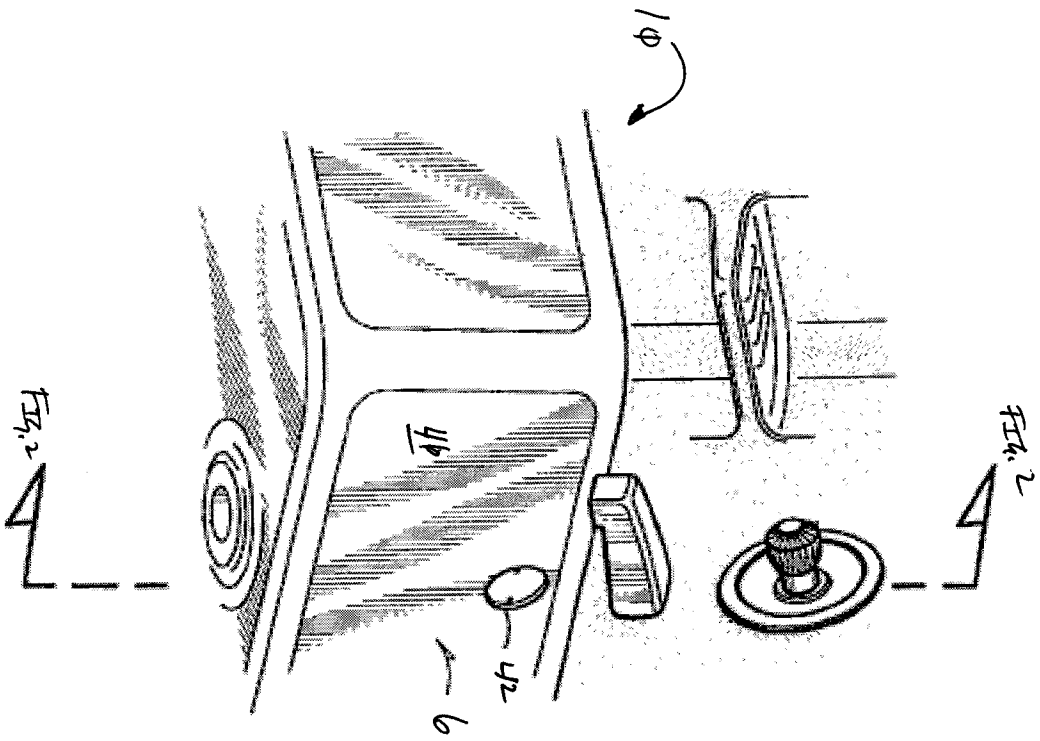
FIG. 1 is a partial perspective view of a typical bathtub.

To assist in the understanding of the present invention the following list of components and associated numbering found in the drawings is provided herein:

| # | Component |
|---|---|
| 2 | Overflow pipe |
| 6 | Sidewall |
| 10 | Bathtub |

-continued

| # | Component |
|---|---|
| 14 | Plate |
| 22 | Sleeve |
| 26 | Inner surface |
| 30 | Inner surface |
| 34 | Screw |
| 38 | Outlet port |
| 42 | Overflow plate |
| 46 | Outer surface |
| 50 | Opening |
| 54 | Overflow plate cover |
| 58 | Outer surface |
| 62 | Wall |
| 66 | Opening |
| 70 | Retention plate |
| 74 | Lip |
| 154 | Overflow plate cover |
| 162 | Wall |
| 166 | Opening |
| 170 | Lip |
| 174 | Inner surface |
| 178 | Upper retention plate |
| 182 | Lower retention plate |
| 186 | Lug |
| 190 | Tab |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 2:
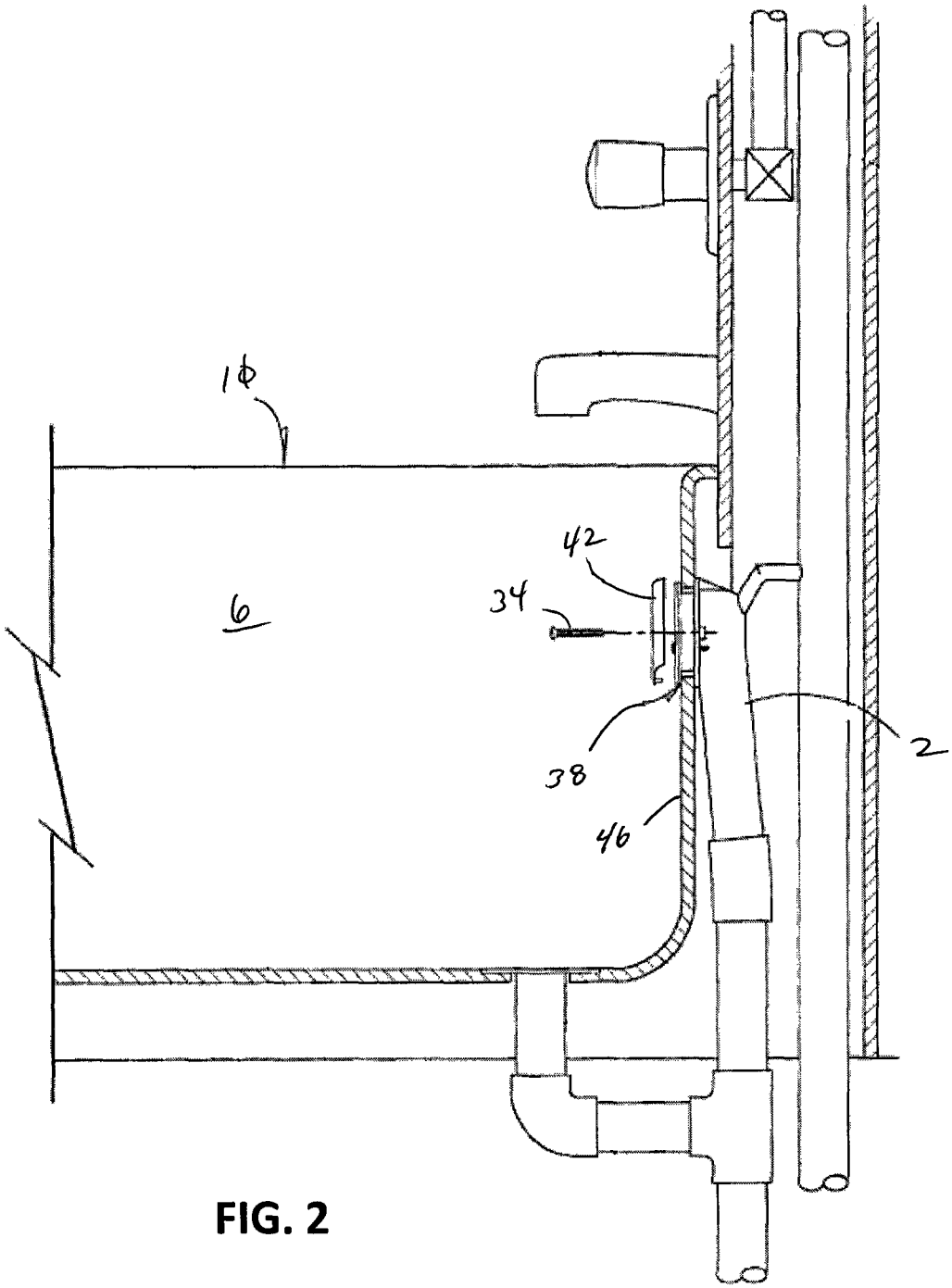
FIG. 2 is a partial sectional view of FIG. 1 showing an overflow system.
Figure 3:
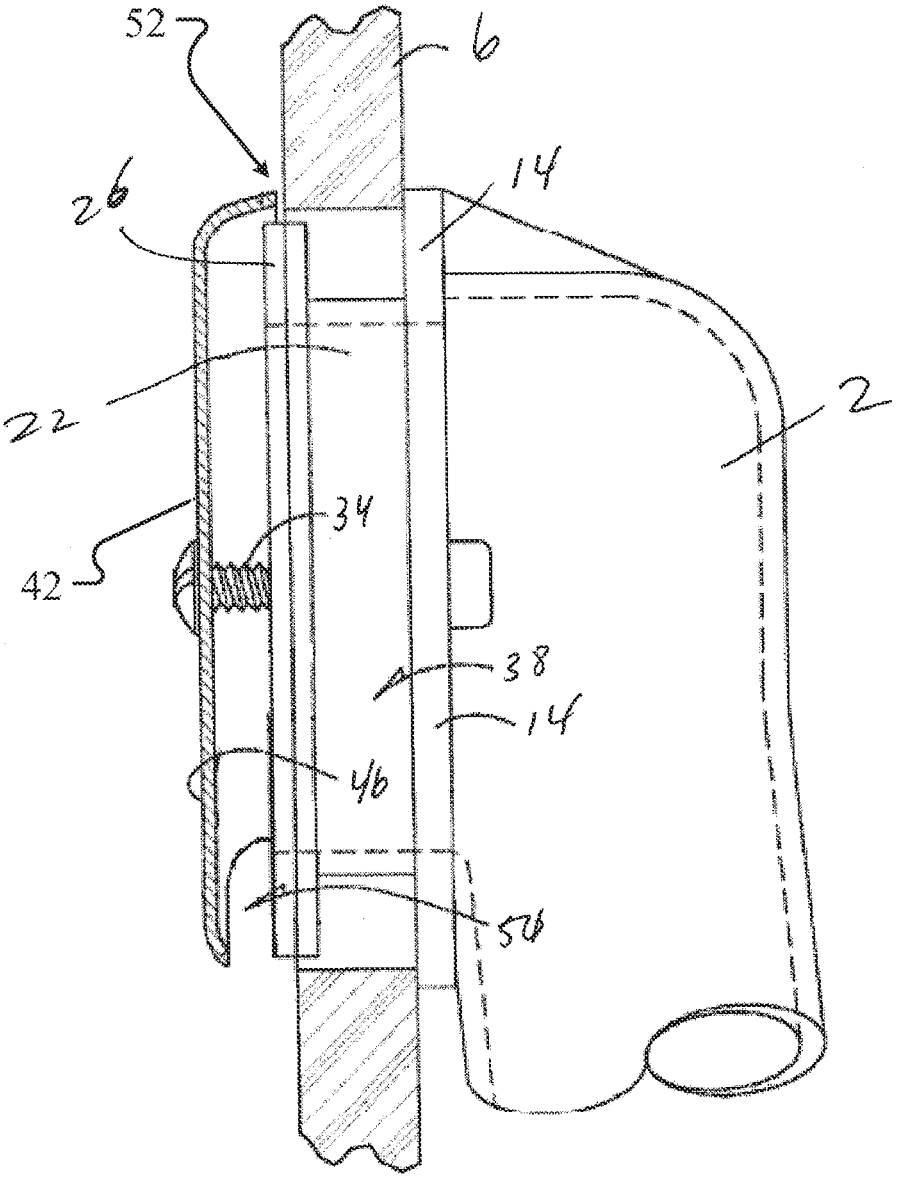
Fig. 3 (Prior Art)
FIG. 3 is a detailed view of FIG. 2.

Referring now to FIGS. 1-3, an overflow system of the prior art is shown. More specifically, an overflow pipe 2 is associated with a sidewall 6 of a bathtub 10. The overflow pipe 2 includes a plate 14 that is abutted against an outer surface of the bathtub 10. A sleeve 22 having an inner surface 26 is abutted against an inner surface 30 of the bathtub wall 6 to secure the overflow pipe 2 to the bathtub 10. The sleeve 22 is associated with the overflow pipe 2 by a threaded interconnection, a friction fit, or any other common attachment scheme. In order to conceal an outlet port 38 associated with the overflow pipe 2, an overflow plate 42 is employed that utilizes the screw 34 to interconnect to the sleeve 22 and/or to the overflow pipe 2. The overflow plate 42 includes an outer surface 46 that conceals the outlet port 38 of the bathtub 10 and a fluid opening 50 that allows fluid to flow within the bathtub 10 and into the overflow pipe 2. After the screw 34 is loosened, the overflow plate 42 is moved away from the sidewall 6 to open a gap 52. An overflow cover plate 54 (illustrated in FIG. 4) is employed to conceal the overflow plate 42. One of skill in the art will appreciate that embodiments of the present invention described below are not limited to incorporation onto the overflow system shown in FIG. 1 and can be used in conjunction with many overflow systems.

Figure 4:
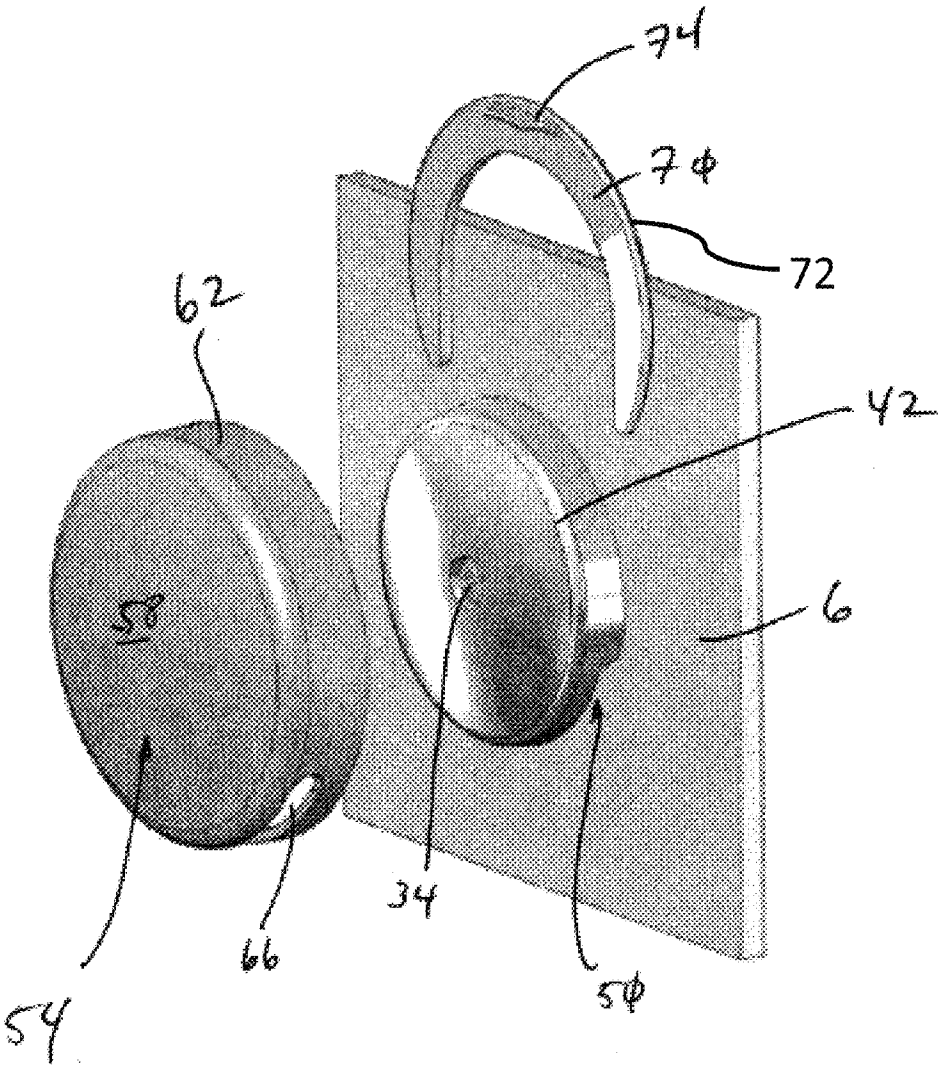
FIG. 4 is a perspective view of one embodiment of the present invention.

Referring now specifically to FIG. 4, one embodiment of overflow plate cover 54 of the present invention is shown that includes an outer surface 58 having a wall 62 depending therefrom. Although shown as cylindrical, one skilled in the art will appreciate that the overflow plate cover 54 may be of any shape and be made of any material or finish. The wall 62 includes at least one opening 66 therethrough that is aligned with a fluid opening 50 of the overflow plate 42. One skilled in the art will appreciate that the opening 66 may also be a cut out similar to that of the overflow plate opening 50 shown, thereby increasing the fluid flow capacity of the overflow plate cover.

In operation, a retention plate 70 is placed between the overflow plate 42 and the bathtub wall 6. In operation, the screw 34 or screws associated with the overflow plate 42 are loosened, but not completely removed, to allow the overflow plate 42 to be separated from the bathtub wall 6 and the retention plate 70 inserted therebetween. Of course, the screw 34 may be removed completely, but those skilled in the art would appreciate that doing such would make it difficult to reconnect the overflow plate 42. Once the retention plate 70 is in place, the screw 34 is tightened, thereby securing the retention plate 70 between the overflow plate 42 and the tub wall 6. Next, the overflow plate cover 54 is associated with the retention plate 70 to conceal the overflow plate 42. In one embodiment, the overflow plate cover 54 detachably engages the outer edge 72 of the retention plate 70. The retention plate 70 may include a lip 74, hooks, lugs, or other mechanisms that cooperate with protrusions (now shown) located on the inner portion of the wall 62. Such interconnection scheme is similar to that shown in U.S. Patent Application Publication No. 2004/0117907, which is incorporated by reference in its entirety herein. In the embodiment shown, however, the lip 74 maintains the retention plate 70 in place so that it will not fall behind the loosen overflow plate 42. One skilled in the art will appreciate that the overflow plate cover 54 may be interconnected to the retention plate 70 in other ways, such as bonding or with other types of interference fit.

Figure 5:
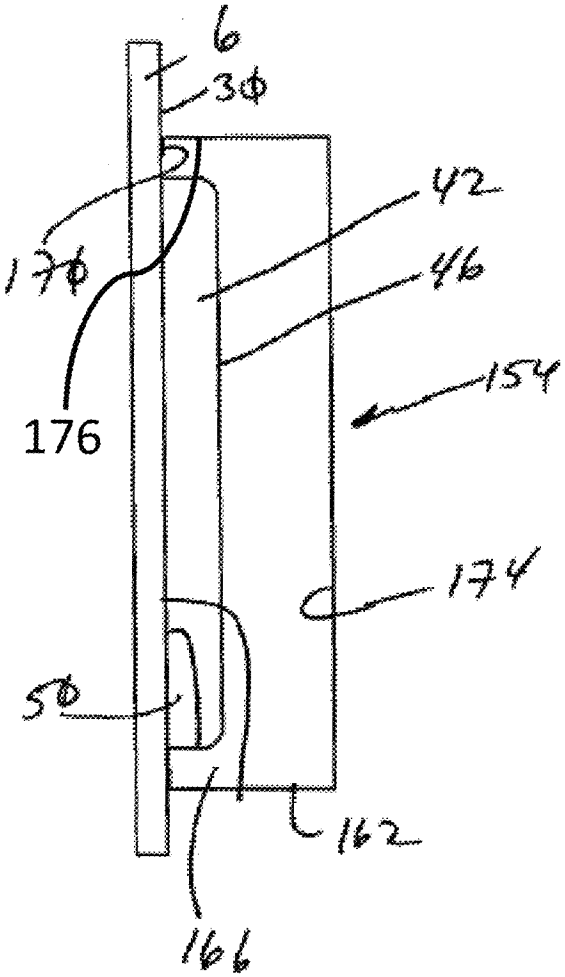
FIG. 5 is an elevation view showing another embodiments of the present invention.

Referring now to FIG. 5, another embodiment of the present invention is shown. Here, the overflow plate cover 154 includes a wall 162 with a lip 170 associated therewith. The lip 170 receives a sealant or other types of adhesives to allow direct bonding to the tub wall 6. One drawback of this system compared to the embodiment of FIG. 4 is that the interconnection is permanent or semi-permanent and may mar the inner surface 30 of the bathtub. Alternatively, an inner surface 174 of the overflow plate cover 154 may include protrusions 176 that are interfaced directly with the outer surface 46 of the overflow plate 42. The overflow plate cover includes an opening 166 that communicates with the opening 50 of the overflow plate 42, as does the overflow plate cover.

Figure 6:
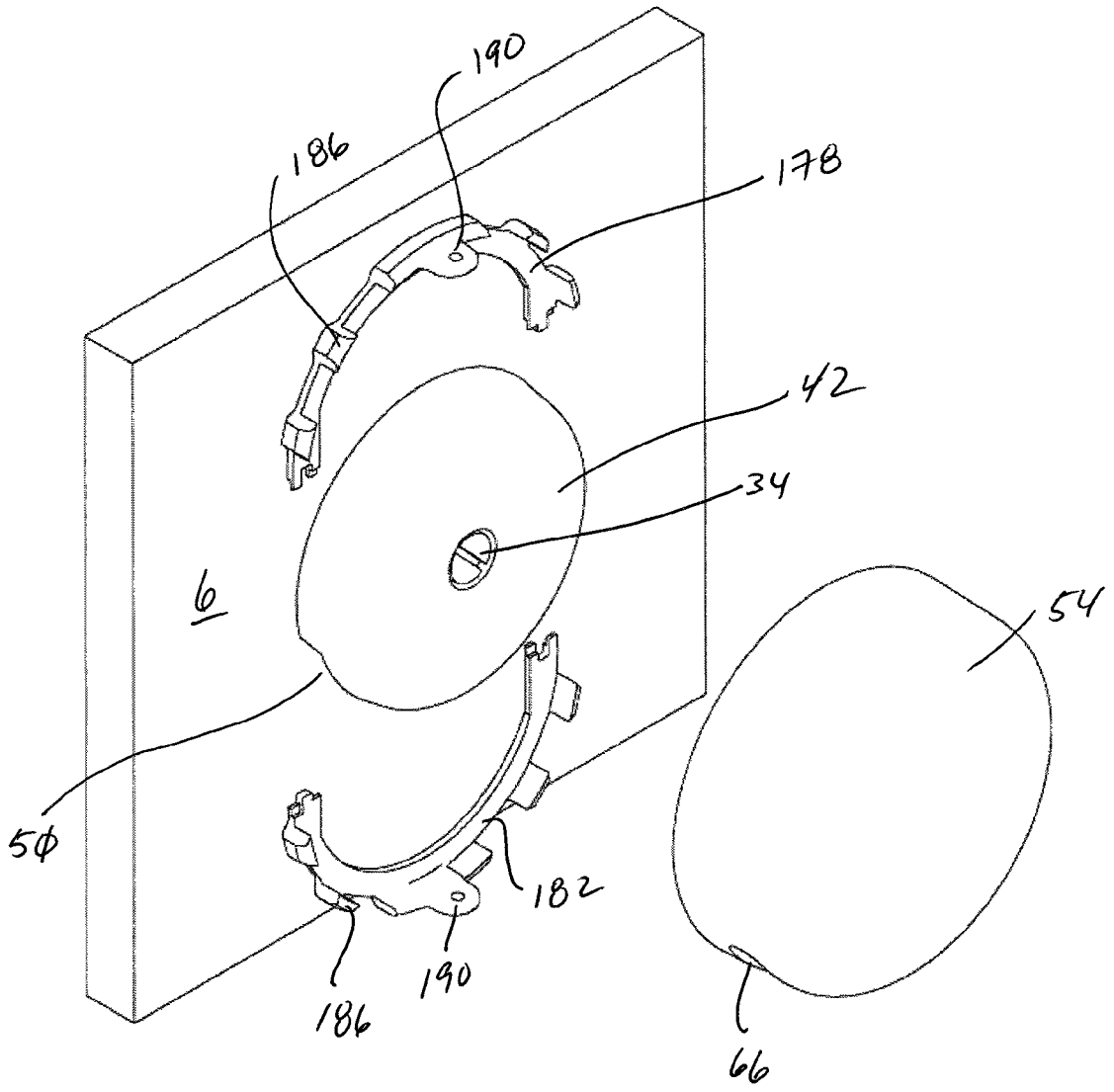
FIG. 6 is an exploded perspective view of another embodiment of the present invention that employs an upper retention plate and a lower retention plate.
Figure 7:
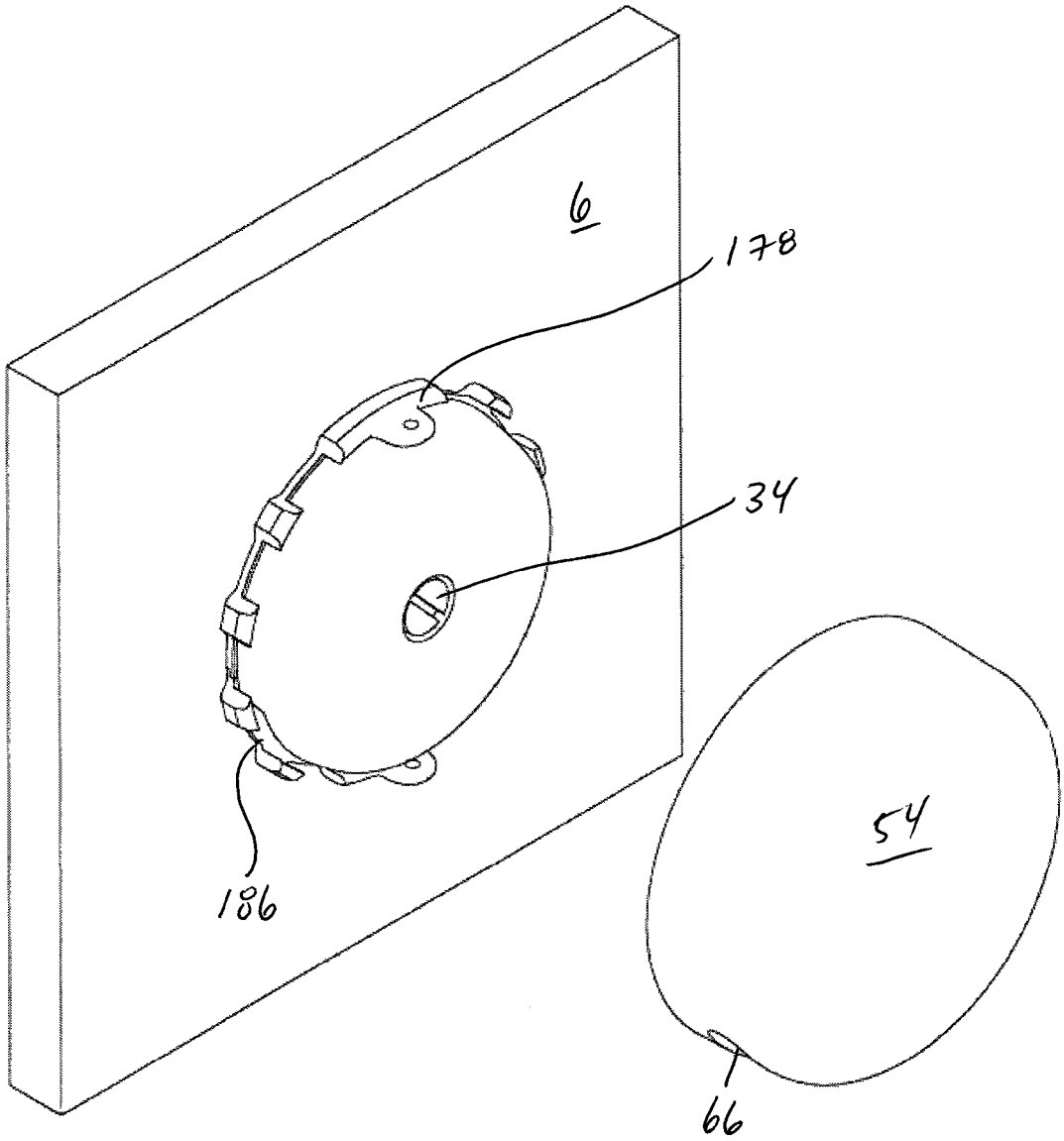
FIG. 7 is a perspective view of FIG. 6 associated with an overflow plate.

Referring now to FIGS. 6 and 7 another embodiment of the present invention is shown that employs an upper retention plate 178 and a lower retention plate 182 that work in conjunction to secure the overflow plate cover 54. The upper retention plate 178 is selectively interconnected to the lower retention plate 182 wherein both the upper retention plate 178 and the lower retention plate 182 employ a series of lugs 186 that interface with an inner surface of the overflow plate cover 54. This interconnection scheme is similar to that disclosed in U.S. Patent Application Publication No. 2004/0,117,907.

In operation, the screw 34, which is associated with the overflow plate 42, is loosened, thereby allowing the overflow plate 42 to be moved away from the sidewall 6. The upper retention plate 178 is then positioned between the sidewall 6 and the overflow plate 42. The lower retention plate 182 is also positioned in the gap between the overflow plate 42 and the sidewall 6 and interconnected to the upper retention plate 178 To facilitate positioning the upper retention plate 178 and the lower retention plate 182, at least one tab 190 may be associated with each of those elements. The tabs 190 may also be used to receive a chain of a chain/stopper drain closure system. Accordingly, the tabs 190 may include a hole or a slot that receives the chain. The upper retention plate 178 and the lower retention plate 182 may interconnect in various ways. Here, a key and slot configuration is provided. One of skill in the art will appreciate that although lugs 186 are shown on both the upper retention plate 178 and the lower retention plate 182 only one of those members may contain lugs 186 to secure the overflow plate cover. Once the upper retention plate 178 and the lower retention plate 182 are in place, the screw is re-tightened which firmly secures the upper retention plate 178 and the lower retention plate 182 between the overflow plate 42 and the sidewall 6. Finally, the overflow plate cover 54 is selectively and detachably interconnected to the retention plates such that the opening 66 thereof is aligned with the opening 50 of the overflow plate.

The embodiments of the present invention disclosed herein may be incorporated with the inventions described in U.S. Pat. Nos. 5,745,931, entitled "Method and Means for Covering the Flange of a Waste Water Strainer", 5,758,368, entitled "Waste Water Valves For Bathtubs and the Like", 6,066,119, entitled "Waste Water Strainer and Valve, 6,148,454, entitled "A Solenoid Control for a Bathtub Waste Water Drain, 6,173,459, entitled "A Control For a Bathtub Waste Water Drain, 6,226,806, entitled "Waste Water Strainer and the Like, 6,317,906, entitled "Strainer Assembly for Bathtub Drains and the Like, 6,418,570, entitled "Drain Closure, 6,546,573, entitled "Drain Cover Assembly, 6,631,623, entitled "Condensate Drain Attachments and Method of Use Thereof, 6,637,050, entitled "Overflow Assembly for Bathtubs and the Like, 6,640,358, entitled "Strainer Assembly for Bathtub Drains and the Like, 6,675,406, entitled "Overflow Assembly for Bathtubs and the Like, 6,675,407, entitled "Solenoid Activated Bathtub Drain Closure, 6,681,420, entitled "Method and Apparatus for Installing a Bathtub Assembly, 6,691,411, entitled "Method of Installing a Waste Water Drain Assembly for a Bathtub, 7,127,752, entitled "Overflow Assembly for Bathtubs and The Like, 7,451,502, entitled "Bath Drain Closure Assembly, 7,503,083, entitled U.S. Pat. "Means for Covering the Flange of a Waste Water Strainer", 2004-0,103,474, entitled "Cap for Sealing a Bathtub Overflow Port for Testing Purposes, 2004-0,117,907, entitled "Method and Apparatus for Assembling and Sealing Bathtub Overflow and Waste Water Ports, 2007-0,130,689, entitled "Tub Box and Method of Using Same, 2008-0,047,060, entitled "Control for a Bathtub Waste Water Drain, 2007-0,039,098, entitled "Bath Drain Closure Assembly, 2008-0,196,161, entitled U.S. CIP Pat. "Flexible Bathtub Waste Pipe Assembly for Bathtubs and the Like", 2008-0,235,866, entitled "U.S. CIP Pat. "Overflow Assembly for Bathtubs and the Like"

This application is also related to various patents and patent publications related to drain systems for tubs and other basins. More specifically, U.S. Patent Application Publication Nos. 2007/0,039,098, filed Aug. 19, 2005 and 2008/0,047,060, filed Aug. 22, 2006, and U.S. Provisional Patent Application Ser. No. 61/089,692, filed Aug. 18, 2008. Furthermore, U.S. Pat. Nos. 5,745,931, filed Feb. 9, 1996; 5,758,368 filed May 21, 1997; 6,148,454, filed Mar. 4, 1999; 6,154,898, filed May 19, 1999; 6,317,906, filed Mar. 10, 1998; 6,173,459, filed May 26, 1999; 6,226,806, filed Aug. 2, 2000; 6,640,358, filed Feb. 6, 2001; 6,418,570, filed Apr. 4, 2001; 6,546,573, filed Jul. 17, 2002; 6,681,420, filed Dec. 3, 2002; 6,675,407, filed Nov. 8, 2002; 7,451,502, filed Aug. 23, 2005 and 7,503,083, filed Aug. 23, 2005, are also related to the inventions described herein. The entire disclosures of each of the prior art references listed above are incorporated by reference herein.

This application is also related to U.S. Patent Application Publication No. 2008/0,196,161, filed Apr. 10, 2008, which is related to a flexible waste water pipe, the entire disclosure of which is incorporated by reference herein.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. However, it is to be expressly understood that such modifications and alterations are within the scope and spirit of the present invention, as set forth in the following claims.

What is claimed is:

1. A device for concealing an overflow plate of an overflow system, the overflow plate having a fluid opening that allows fluid to pass from a basin to which the overflow system is associated, comprising:

a retention plate adapted to be positioned between the overflow plate and the basin, the retention plate having a lip; and an overflow plate cover for interconnection to said retention plate, said overflow plate cover having an outer surface with a wall extending therefrom with an opening therethrough that is adapted to be aligned with the opening of the overflow plate to provide a continuous fluid flow path from inside the basin to the overflow system, the overflow plate cover having an inner protrusion, wherein the lip interfaces with the inner protrusion.

2. The device of claim 1, wherein said overflow plate cover engages an outer edge of said retention plate.

3. A device for concealing an overflow plate that is associated with an overflow pipe, the overflow plate having a fluid opening that allows fluid to pass from a basin to which the overflow pipe is associated, comprising:

an upper retention plate adapted to be positioned between the overflow plate and the basin;

a lower retention plate interconnected to said upper retention plate;

a cover for selective association with at least one of said upper retention plate and said lower retention plate, said cover comprising a side wall with an opening therethrough that is adapted to be aligned with the opening of the overflow plate to provide a continuous fluid path beginning from inside the basin to the overflow pipe.

4. The device of claim 3, wherein at least one of said upper retention plate and said lower retention plate includes a lug that interfaces with said side wall of said cover.

5. The device of claim 3, wherein said lower retention plate is adapted to be positioned between the overflow plate and the basin.

6. The device of claim 3, wherein at least one of said upper retention plate and said lower retention plate includes a tab.

7. The device of claim 3, wherein said upper retention plate and said lower retention plate interlock.

8. A method of concealing an overflow plate that is associated with an overflow pipe of a plumbing system, the overflow plate having a fluid opening that allows fluid to pass from a basin to which the overflow pipe is associated to the overflow pipe, the overflow plate being associated to the overflow pipe by way of at least one fastener, comprising:

loosening said fastener;

moving said overflow plate from said basin;

positioning a retention plate between said overflow plate and said basin, the retention plate having a lip;

tightening said fastener; and interconnecting an overflow plate cover to said retention plate, wherein said lip interfaces with said overflow plate cover.

9. The method of claim 8, wherein said overflow plate cover includes an outer surface with a wall extending therefrom with an opening therethrough that is adapted to be aligned with the fluid opening of the overflow plate to provide a continuous fluid path.

10. The method of claim 8, wherein said fastener is not completely disassociated with said overflow pipe.

* * * * *